US005129654A

United States Patent [19]

Bogner

[11] Patent Number: 5,129,654

[45] Date of Patent: Jul. 14, 1992

[54] ELECTRONIC GAME APPARATUS

[75] Inventor: Bruce F. Bogner, Mount Holly, N.J.

[73] Assignee: Brehn Corporation, Mount Holly, N.J.

[21] Appl. No.: 638,471

[22] Filed: Jan. 3, 1991

[51] Int. Cl.[5] ..... A63F 3/02; G06F 3/03; G06F 15/44

[52] U.S. Cl. ..... 273/238; 273/237; 273/239; 273/260; 434/128

[58] Field of Search ..... 273/237, 238, 239, 260, 273/286, 287; 434/128, 338, 339, 340

[56] References Cited

U.S. PATENT DOCUMENTS

| | | | |
|---|---|---|---|
| 3,760,404 | 9/1973 | Khlebutin | 273/238 |
| 4,492,581 | 1/1985 | Arai et al. | 273/238 |
| 5,013,047 | 5/1991 | Schwab | 273/238 |

FOREIGN PATENT DOCUMENTS

| | | | |
|---|---|---|---|
| 3309817 | 9/1984 | Fed. Rep. of Germany | 273/238 |
| 3813779 | 11/1989 | Fed. Rep. of Germany | 273/237 |
| 0133328 | 11/1978 | Japan | 273/238 |
| 0606589 | 5/1978 | U.S.S.R. | 273/237 |
| 2103943 | 3/1983 | United Kingdom | 273/238 |

*Primary Examiner*—Edward M. Coven
*Assistant Examiner*—Jessica J. Harris
*Attorney, Agent, or Firm*—Panitch Schwarze Jacobs & Nadel

[57] ABSTRACT

An electronic game apparatus which includes a playing board having a playing surface and playing areas and is capable of identifying game pieces and their position on the playing surface. First and second sets of parallel transmission lines are located beneath the playing surface of the playing board. The second set of parallel transmission lines is orthogonal to the first set of transmission lines. The first and second sets of transmission lines form intersecting points which are positioned proximate to a playing area of the playing surface. A source of electromagnetic energy has a plurality of predetermined different frequencies within a predetermined frequency range. A plurality of game pieces, each containing a resonant circuit having a predetermined resonant frequency, correspond to a frequency within a predetermined frequency range. A selector sequentially supplies electromagnetic energy at a selected frequency within the predetermined frequency range to the first set of transmission lines. A detector connected to the second set of transmission lines determines the presence of a game piece by detecting electromagnetic energy at a frequency within the predetermined frequency range on one of the transmission lines.

21 Claims, 11 Drawing Sheets

64
OSC 1
64
OSC 2
64
OSC n $V_{CC}$
68
TO
SP8T
SWITCH
70
66
72
TO SP8T
SWITCH
CIRCUIT
74154
7493
COMPUTER
PULSE
+5V
CONTROL
LINE
BUFFERS
+12V
GND

ELECTRONIC GAME APPARATUS

FIELD OF THE INVENTION

This invention relates to an adversary type game apparatus suitable for play between two or more players, one of which may be a computer and which provides means for identifying playing pieces and their location.

BACKGROUND OF THE INVENTION

For years, people have been playing games such as chess, checkers, scrabble, monopoly, etc. which utilize game boards and game pieces which are positioned on a board. The position or identity of any game piece on the board was determined by human observation, since no other system existed. If one desired to record the position of each game piece as a game progressed, one would have to perform such an operation manually. There are some particular board games, in particular, chess, where it is advantageous to record all game piece positions throughout the game, so that the game can be studied by skilled players as well as by other players of lesser skill, so they can improve their skill. For this reason, the description of the invention will be in terms of chess and utilize a chess board and chess pieces. However, the invention can be applied to other board games with varying degrees of advantage.

Serious players of the game of chess find it important to record every move of every game so that the game can be re-played for the purpose of detecting and correcting mistakes and learning how to improve their playing ability in future chess matches. When the game is played on a standard chess board, the moves are recorded manually. This method of recording moves has a significant drawback, namely that it is relatively slow. There is a type of chess game known as "speed chess" where each player is encouraged to make his move as soon as possible after an opponent makes their move. In this type of game, it is not possible to manually record the moves. When such a game is played by the leading players in the world, other high level players would like the opportunity to study such a game, but are denied the opportunity because the game cannot be manually recorded.

Another disadvantage of a "standard" chess game is that the number of spectators that can observe the actual match is very limited, and often spectators are denied the privilege of watching for fear of disturbing the players. Such games are usually recreated on a secondary chess board and displayed for an audience in another room or at a remote location. There is a definite need for a chess set which would eliminate these deficiencies and allow a game to be automatically recorded, no matter how fast the players move the pieces, and that would allow a large audience to observe the game without disturbing the players.

Several years ago, a board was invented which contained, among other features, a switch under each square, and an element in each piece which activated the switch when a piece was on that square. With this system, the board could detect which squares contained a chess piece and which squares were vacant. Unfortunately, the board could not identify the rank of the piece that was on each square. In order to compensate for this piece recognition problem, the board assumed an initial starting position of each piece (standard position at the start of each game), and then kept track of each piece as a square was vacated and another vacant square became occupied. Sufficient information was available for the board to figure out what had occurred. Of course, the board could be fooled if two pieces were purposely interchanged. Another problem arose if a game was to be resumed after a recess. There would have to be a means of communicating to the board where each piece was, so the board could resume keeping track of each piece. Another drawback is that these switches are generally slow. Therefore, a speed chess game probably could not be effectively recorded by such a board. There is obviously a need for a chess board which not only can keep track of a game in progress, but can identify which piece is on every square at all times as well as perform these functions faster than a person can move a piece.

U.S. Pat. No. 3,760,404 (Khlebutin) discloses a chess board which places a single coil under each playing square. A pulse of energy is fed sequentially to each coil which shock excites a resonant circuit in the chess piece located on the square selected. The coil picks up the oscillations from the piece's resonant circuit, and an analysis circuit determines the resonant frequency. Each piece has its own unique resonant frequency which allows the analysis circuit to determine the identity of the piece.

Great Britain Patent No. GB 2 103 943 (Blenkinsop, et al.) discloses two embodiments of a chess board which places coils under the playing surface of the board. In the first embodiment, a transmit coil and a receive coil are located under each square. Each square is searched sequentially. The transmit coil is energized by a short duration pulse of energy. Each chess piece contains a resonant circuit, comprising an inductor in parallel with a resonating capacitor, which produces a response on both the leading edge of the input pulse and the trailing edge of the input pulse. This is known as an impulse or shock excitation, and such an impulse contains energy at a broad spectrum of frequencies. The chess piece produces a response at its resonant frequency (corresponding to its identity), and the response is picked up by the receive coil and delivered to an analysis circuit which determines the frequency of the response and therefore the identity of the piece. Only the response to the trailing edge of the input pulse is analyzed.

In the second embodiment, a single coil is placed under each square. Each square is searched sequentially. Instead of a short duration pulse, a triangular, or ramp excitation pulse is employed since only the trailing edge is needed for the impulse excitation. The signal on the coil resulting from the piece's resonant frequency occurs after the ramp excitation has ended, thus allowing a single coil to replace the pair of coils described in the first embodiment. The single coil embodiment functions thereafter in the same manner as the first embodiment. Impulse excitation of a playing piece resonant circuit is employed as the basic technique. The trailing edge of a ramp or short pulse is used to provide the basis for the impulse. To be effective, the impulse must occur in a very short time, as well as contain considerable energy created by a large change in voltage level. The shorter the time span of the impulse, the greater its frequency spectrum; the greater the change of voltage for the impulse, the greater the energy at each frequency. The ramp or pulse is directed to a particular coil beneath a playing square on the board. The coil requires considerable inductance, which translates to many turns, in order to convert the abrupt voltage change to a high energy impulse. The coupling between the coil beneath the playing surface and the coil in the playing piece is the mechanism for transferring the impulse into the resonant circuit of the piece.

A resonant circuit is characterized by its "Q", a factor which is the ratio of output voltage to input voltage at a particular frequency. Since the input signal to the piece is an impulse which contains virtually all frequencies, it is apparent that the amount of energy at any one particular frequency is quite small. In order to produce an output signal which is strong enough to be processed for the purpose of piece identification, the "Q" of the resonant circuit in the piece must be quite high, since the input energy level at that frequency is necessarily quite small. A high "Q" requires a large inductance, which translates to many turns of wire on a ferrite core to concentrate the magnetic field produced by the current induced in the windings. The smallest number of turns of any piece, as described in the prior art, is 133, and the largest number is 185. A capacitor is connected in parallel with the coil in the piece to create a resonant circuit and is tuned to a particular frequency. When such a circuit is excited, it produces oscillations at its resonant frequency as well as at harmonics of that frequency.

In the present case, the harmonics of the frequency can be ignored, and only the "fundamental" frequency is of interest. The response from the piece resonant circuit is in the form of damped oscillations. The response is characterized by a large amplitude oscillation immediately following the impulse excitation, followed by continuously decreasing amplitude oscillations until the signals become indiscernible from noise. It is this pattern of oscillations which couple back to the coil beneath the board surface. In order to effectively process the oscillations received by the coil under the board, the analysis circuit must be blanked until such time as the original impulse and any non-linear effects of the impulse die out and the only signal remaining on the coil are the decaying oscillations generated by the piece resonant circuit.

Many problems are associated with the prior art. One such problem is the creation of a high energy impulse. For the impulse to be effective, the impulse must contain considerable energy at the frequency of each piece, in order to be able to effectively excite each piece. The impulse also contains considerable energy at other frequencies, both below and above the span of frequencies of the pieces. This energy radiates from the coil under the board and potentially interferes with other electrical and electronic apparatus in the vicinity of the board. Every country effects very strict radiation standards in order to control this type of radio frequency interference (RFI). It would be difficult and possibly impossible for a company producing a board operating on an impulse basis to obtain a license to market such a board to the general public.

In addition, the coil under the board square must contain many turns to generate the high energy impulse needed for effective operation. This restricts the minimum size of the square, and resulting size of the overall board to a board approaching tournament size, which utilizes approximately 2¼ inch squares. For a product utilizing "smart board" technology, not being able to make small chess sets is quite restrictive.

The coil in each piece must also have a high "Q" in order to generate sufficient energy at its particular resonant frequency for an analysis circuit to determine its identity. Such a coil with a large number of turns of wire wound on, for example, a ferrite form is not only expensive to produce, but cannot be made to fit into small chess pieces which would be employed on chess sets materially smaller than tournament size.

The need to couple energy between the coil under the playing surface and the coil in a piece above the board creates a positioning problem for a piece. As a piece is moved away from the center of a square, the signals coupling from one coil to the other diminish in a non-linear fashion, which is characterized by the signal level decreasing faster and faster as the piece is displaced in equal increments of distance. This causes the piece to rapidly become undetectable as the piece moves away from the center of a square. Increasing the level of the excitation signal only improves this situation slightly due to the non-linear behavior. Increasing the inductance of the coil under the board, or the "Q" of the piece circuit also has a small effect on this problem. Most attempts to overcome this problem with increased excitation only aggravates the RFI problem.

In order to uniquely determine the identity of a piece on a playing square, each square must be addressed individually, or sequentially. This adds to the number of wires that must be located beneath the playing surface, as well as the total time it takes to search for all pieces and affects the ability of the smart board to effectively handle speed chess games. This system of piece recognition has several significant drawbacks. First, the necessity to place numerous multi-turn coils below the playing surface of the board limits the minimum size of the squares on the board to approximately 2 inches (a tournament board utilizes approximately 2¼ inch squares). In addition, this type of construction is expensive, and does not lend itself to significant production cost reduction through automation. Second, when two coils are utilized beneath each square, the transmit coil couples to the receive coil even when no piece is present. This is akin to a "false alarm". Special circuits are needed to reduce the false alarms to a tolerable level. Third, the board "radiates" electrical energy into the air, with the potential of interfering with other nearby electronic equipment. By reciprocity, other nearby electronic equipment could interfere with the operation of the board. The allowable level of radiation from any electrical or electronic device (such as the "smart board" being described) is strictly regulated in every country. Before such a device can be sold, a license must be obtained, which depends in part on the device passing an electronic emission test. Finally, the physical embodiment of the circuit in each piece occupies considerable volume, is costly, and probably requires adjustment by an assembler, which in itself is expensive. Clearly, a different approach to piece recognition is needed if a cost effective, low radiation "smart board" is to become a household item.

SUMMARY OF THE INVENTION

The present invention accomplishes the task of piece location and identification without the use of coils under the playing surface and without the use of costly circuitry in each playing piece. In addition, the present invention can be realized in various size chess boards, from tournament size (e.g., 2¼" squares) to a relatively small size (e.g., ½" squares). Also, the method of detection of this invention utilizes electrical signals which are of such a nature and level that they are barely detectable, which greatly reduces or eliminates the radiation problem.

The present invention uses a signal tuned to the resonant frequency of each type of playing piece in order to locate and identify that type of piece, as opposed to an impulse excitation of the piece resonant circuit. The advantage is that a relatively small amount of energy is needed to produce a response in the corresponding piece since the incident energy is at the proper frequency.

A pair of balanced two wire transmission lines, matched in their characteristic impedance, transfers the input signal to the vicinity of the piece being sought as well as transferring a portion of the input signal to a means for detecting the presence of that piece. One such transmission line is installed under each of the eight columns and each of the eight rows of the chess board. The advantages of this configuration over the coils are: a) a low energy signal at the resonant frequency of the piece being sought reduces the potential RFI problem; b) only eight columns and eight rows have to be searched, as opposed to 64 individual squares; c) the two wire transmission line being utilized is basically a non-radiating structure which also reduces the potential RFI problem; d) the transmission lines can be made to accommodate any size squares, allowing small chess boards to utilize this technology with the same effectiveness as a large size board; e) the transmission lines are much less costly to produce than the coils, and are also relatively non-critical in their installation; f) the physical separation of the wires of the two wire transmission lines can be adjusted so that their effectiveness in properly exciting the resonant circuit in a piece is virtually the same over the entire area of a playing square, virtually overcoming the position sensitivity problem associated with the prior art.

The present invention also utilizes a planar low "Q" coil in the base of each piece, as opposed to the high "Q" multi-turn coil wound on a (e.g.) ferrite core in the prior art. This not only makes each piece less costly to produce, but makes it possible to produce smaller chess pieces, since the printed coil does not require a high "Q" or a large coupling coefficient. The planar coils can be mass produced utilizing printed circuit technology and do not require tuning adjustments at assembly.

A set of eight transmission lines transfers a signal from a signal source to the area occupied by a playing piece. An orthogonal set of eight transmission lines transfers a signal from a playing piece to a detector. Since only a signal at the resonant frequency of the playing piece being sought is employed at any time, there is no need for any analysis circuitry as used in the prior art. At any square that does not contain a piece, or contains a piece not being excited at its resonant frequency, there is negligible coupling between the eight column transmission lines and the eight orthogonal row transmission lines, so that there is no measurable output from any of the eight detectors connected to the row transmission lines. However, when a piece is excited at its resonant frequency, a significant amount of energy is transferred from the column transmission line to the row transmission line which cross under the square occupied by the piece. It is this ability of a low "Q" resonant circuit to transfer power between orthogonal, transmission lines that produces the advantages associated with this invention.

To further appreciate the difference in approach compared to the prior art, the low frequency energized coil of the prior art located beneath each square is surrounded by a tightly coupled electromagnetic field which must interact with the circuitry in a playing piece in order to generate sufficient signal strength to allow a positive piece identification to be made. This is fairly restrictive on the positional accuracy of the piece, and it is not uncommon for a piece to be undetectable if it were positioned away from the high energy area of the coil which is at the center of each square. The transmission lines, an arrangement of conductive elements (in this case wires) capable of guiding an electromagnetic wave in a prescribed fashion with relatively small loss of signal strength, has a loosely coupled electromagnetic wave which interacts with the circuitry in a piece over a wide latitude of piece position over the entire square in question. This allows the resonant circuit in the piece to interact with the wires of the associated two wire transmission line in order to transfer energy to the orthogonal transmission line and produce a detectable signal, needed for piece location and identification.

Unfortunately, it is not possible to totally solve the piece positional sensitivity problem under all circumstances. Since a computer connected to the present invention has analysis capability, it is easier for such a computer to determine overall piece positions if a square reported that it contained more than a single piece, as opposed to allowing a piece to just "disappear" from the board, as in the prior art. A typical reporting system consists of generating the ASCII code corresponding to the piece on a particular square, and then transmitting a string of 64 bytes to the computer. By pre-arranging the order that the squares are reported, the computer can reconstruct the board position. Empty squares are sometimes reported with the ASCII code for a ".", and a square "with more than one piece", with the code for a "*". Such coding is purely arbitrary and is described here in order to provide an illustrative example.

The present invention is directed to an electronic game apparatus which includes a playing board having a playing surface and playing areas. A first set of parallel transmission lines is located beneath the playing surface of the playing board. A second set of parallel transmission lines is also located beneath the playing surface of the playing board. The second set of parallel transmission lines is orthogonal to the first set of transmission lines. The first and second sets of transmission lines form intersecting points which are electrically isolated from one another. Each intersecting point is positioned proximate to a playing area of the playing surface. A source of electromagnetic energy has a plurality of predetermined different frequencies within a predetermined frequency range. A plurality of game pieces, each containing a resonant circuit having a predetermined resonant frequency, correspond to a frequency within a predetermined frequency range. A selector sequentially supplies electromagnetic energy at a selected frequency within the predetermined frequency range to the first set of transmission lines. A detector connected to the second set of transmission lines detects the presence of electromagnetic energy at a frequency within the predetermined frequency range on one of the transmission lines. The presence of a game piece results in the generation of electromagnetic energy within a transmission line on the second set upon receipt of the resonant circuit within the game piece of electromagnetic energy at a frequency corresponding to the resonant frequency of the resonant circuit within the game piece from a transmission line of the first set. The detector detects the electromagnetic energy within the transmission line of the second set.

BRIEF DESCRIPTION OF THE DRAWINGS

The foregoing summary as well as the following detailed description, will be better understood when read in conjunction with the appended drawings. For the purposes of illustrating the invention, embodiments which are presently preferred are shown in the drawings. It is understood, however, that this invention is not limited to the precise arrangements and instrumentalities shown.

The invention will be described with reference to the accompanying drawings in which.

DETAILED DESCRIPTION OF THE INVENTION

Figure 2:
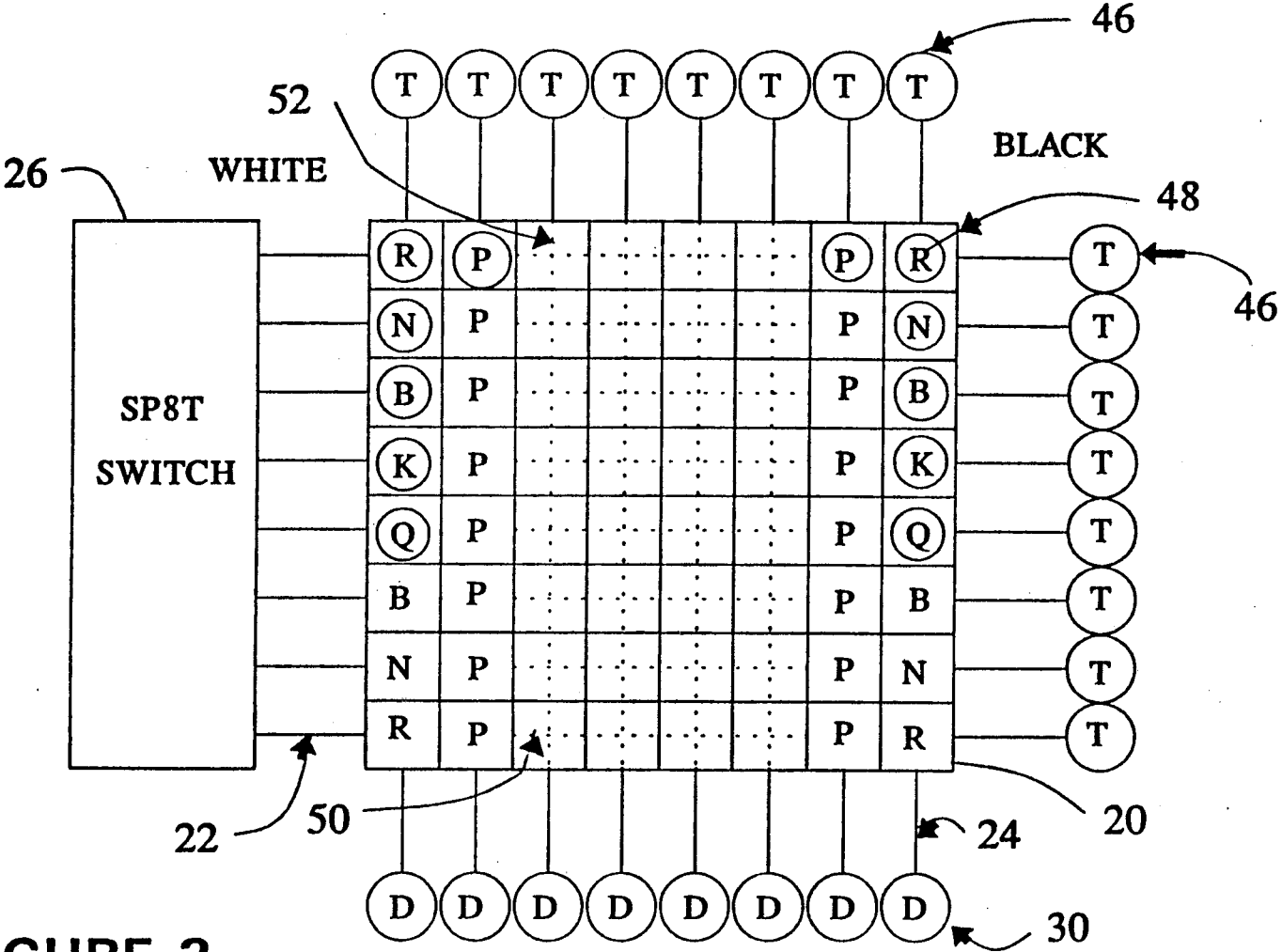
FIG. 2 shows the details of a chess board according to the present invention.

Referring to the drawings in detail, wherein like numerals indicate like elements throughout, a preferred embodiment of the electronic game apparatus or playing board of the present invention is illustrated in FIG. 2. Below the playing surface of the board, 16 two-wire transmission lines are arranged, a first set of transmission wires comprising 8 pairs of wires generally parallel to each other on one layer and arranged in a first direction and a second set of transmission wires comprising 8 pairs of wires generally parallel to each other and arranged in a second direction different from the first direction, such that the first set and second set of transmission wires form electrically isolated intersecting points. The second set of transmission wires is preferably, but not necessarily orthogonal to the first set of transmission lines. An alternate and equally viable arrangement has all 16 transmission lines in a single layer, with wires electrically insulated from each other at all intersecting points. The board can be considered as an arrangement of 8 columns and 8 rows. The game pieces, which are preferably chess pieces, are considered to be initially arranged on four rows at the start of a game. Each of the transmission lines on a column is preferably comprised of a two wire transmission line extending across the entire board, with a connection to a source of an electromagnetic signal at one end, and a termination at the other. Each of the transmission lines on a row is composed of a two wire transmission line extending across the entire board, with a connection to a detector circuit at one end, and a termination at the other. The two wire transmission line is partially characterized by its "characteristic impedance", which in a typical design may have a value, say, between 75 ohms and 500 ohms. For reference purposes a conventional flat TV twin lead would be a two wire transmission line having a characteristic impedance typically of 300 ohms. The termination for such a transmission line could be a resistor with a value which matches the characteristic impedance, which in this example of the TV twin lead, would be 300 ohms. It is a characteristic of a two wire transmission line which is terminated in its characteristic impedance that electromagnetic signals, incident on that transmission line, travel towards the termination with little or no radiation, and that virtually all the energy which reaches the termination is absorbed in the termination with little or no reflection or radiation. A two wire transmission line is utilized primarily due to the basic high isolation between orthogonal sets of transmission lines, and the effectiveness of transferring energy from one transmission line to an orthogonal transmission line in the presence of a playing piece containing a resonant circuit. However, it is not effective to utilize a two wire transmission line in the rest of the auxiliary circuitry since such a transmission line is difficult to shield. An unbalanced transmission line, characterized by a single conductor and a ground is generally utilized to best advantage. In this type of system, a common ground exists between various circuits and undesired coupling between circuits can be avoided by use of shielding, which generally makes use of the common ground existing between circuits. Use of unbalanced transmission lines to feed signals to the board, and to detect signals from the board makes the use of "BALUNS" necessary to interconnect an unbalanced transmission line to a balanced two wire transmission line. The term "BALUN" is an acronym for BALanced to UNbalanced transformer. The device assures that efficient transfer of energy takes place at the connection between the two types of transmission lines, and that the proper electromagnetic waves are established on each transmission line so that the planned electrical functions occur effectively.

The present invention utilizes a resonant circuit in each chess piece, wherein 12 different chess pieces use 12 different frequencies to distinguish between the 32 playing pieces (6 different playing pieces of each color with all similar pieces equipped with similar frequency sensitive circuits). In a tournament set, where pawns reaching the 8th rank can be exchanged for other pieces, additional pieces must be provided, and equipped with the proper identifying circuitry. One such set of extra pieces consists of two extra queens, and one each bishop, knight, and rook for each color (total of 10 extra pieces). This makes the number of pieces which must be generated equal to 42.

Unlike the prior art devices which required a high Q circuit in each piece in order to achieve the needed sensitivity, the present invention can utilize a low Q circuit. The key differences between these configurations is that the high Q circuit needs a conductor wound on a (e.g.) ferrite core with a large number of turns (greater than 100) to achieve the electrical results while the low Q device can utilize a simple wound coil (less than 10 turns) in a common plane. This coil can be flat, on the base of the piece, so as to be in a position to interact with the transmission lines beneath the board surface. A production version of the piece circuit may very well be a printed circuit coil attached to the base of the piece. In order to complete the resonant circuit, a capacitor must be connected in parallel with the terminals of the coil. Because the present invention only requires low Q circuitry, the use of highly reproducible coils, coupled with the use of high tolerance capacitors should make it unnecessary to have to specially tune each piece circuit for the correct frequency of operation. It is a combination of a simpler physical configuration and the lower Q, which makes a fixed tuned circuit possible, that enables an inexpensive chess piece to be realized.

Figure 1:
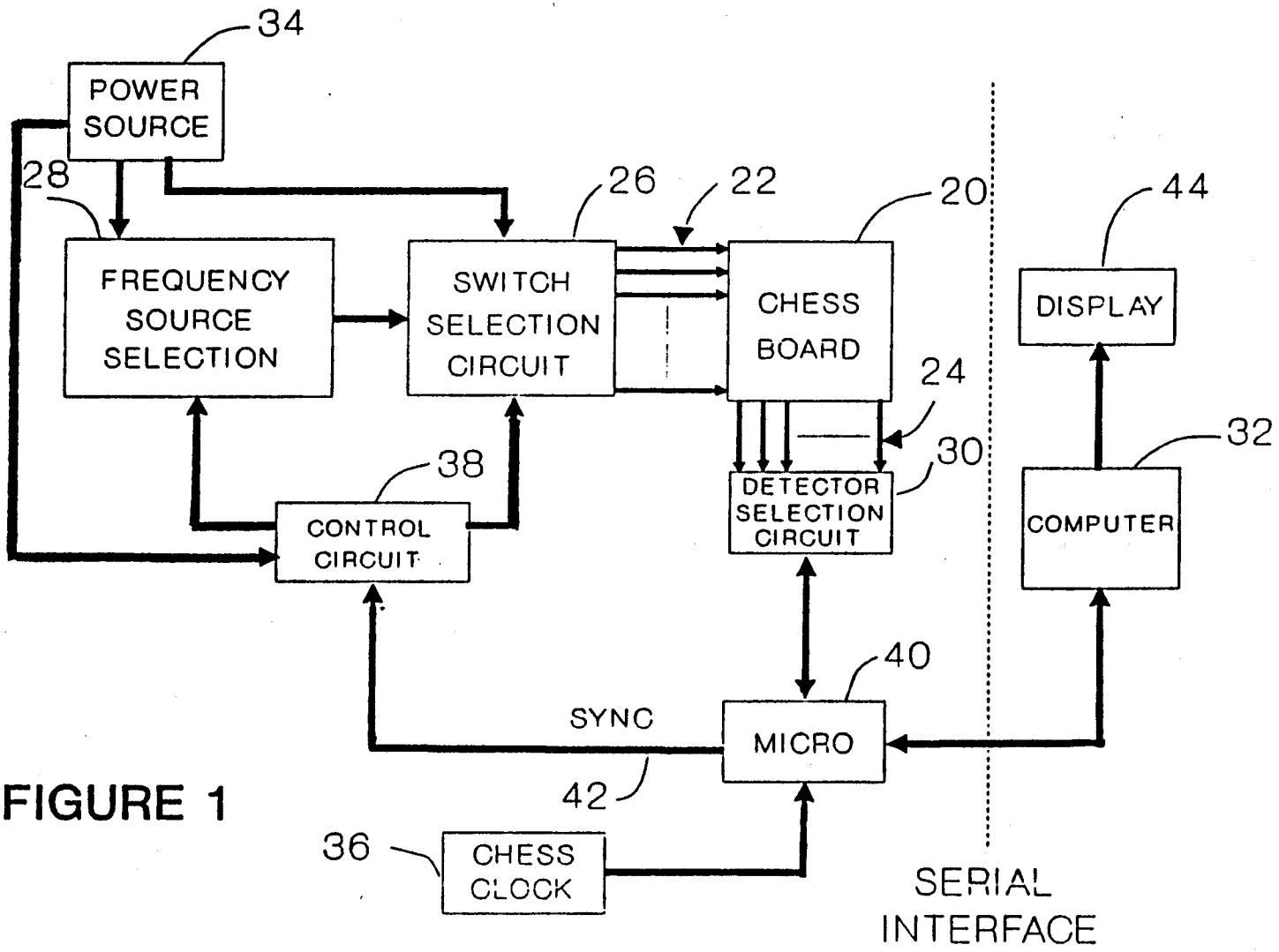
FIG. 1 shows a block diagram of a system which utilizes the present invention.

The chess board 20 in FIG. 2 can be considered to be arranged in 8 columns and 8 rows, with the intersection of a column and row defining a playing area which is preferably square-shaped. Transmission lines 22 are connected to the columns and transmission lines 24 are connected to the rows. The invention will also be valid if 22 were connected to the rows and 24 to the columns. Referring to FIGS. 1 and 2, a selector means for connecting any one column 22 to a frequency source 28 is provided by selection switches 26 and control circuit 38. Frequency source selector 28 provides any one of the available frequencies upon command from control circuit 38. By way of example, the frequencies could be 27 MHz, 29 MHz, 31 MHz, and so on. Only one frequency is produced at any one time in order to eliminate excess radiation from the assembly as well as any ambiguity in the decision making process.

A source of electrical power, either a.c., d.c., or some combination, required by 26, 28 and 38 is provided by power source 34. In the present instance, +12 volts is required by the oscillators in 28, and +5 volts is required by circuits 26 and 38. In one embodiment of the invention a common power supply is used to convert standard 115 volt 60 cycle single phase power to the required D.C. voltage levels. The precise power required and the precise manner of generating that power is not significant to the operation of the invention.

As the system cycles through all combinations (12 frequencies times 8 columns), the information regarding the location and identification of each playing piece on the board is sent along transmission lines 24 to a detecting means which is preferably a detector circuit 30. The outputs of the detector circuits 30 are fed directly to the MICRO 40, whose output is then fed to the serial port of the processing means which is preferably a computer 32. The MICRO 40 is used to interface with the computer 32 and to control the excitation circuits 26, 28, 38 via line 42 as well as to decode the output of the detector circuit 30. Inputs from a chess clock 36, modified to allow the MICRO 40 to know when a move has been completed, can be used to trigger a scan of the board 20. The system can also be operated utilizing the computer 32 to control the entire operation. However, all these variations on the system do not limit or affect the present invention, but are merely variations of how the invention could be utilized. The position of all the pieces on the board can be displayed on display 44.

FIG. 2 shows how the chess board 20 is wired and how the pieces 48 are initially arranged on the board. The circles around selected pieces 48 are merely to show that there are twelve unique types of pieces, six "white" and six "black". Every piece 48 has incorporated within a means by which the system can determine its identity. The board 20 and pieces 48 as shown in FIG. 2 are arranged in the standard "starting position", with lines 22 being connected to the columns and lines 24 to the rows. In one possible embodiment, every piece 48 would employ a different frequency and it would not matter how many "similar" pieces were on any row or column since only one piece 48 can respond to any one signal. However, if similar pieces 48 were tuned to the same frequency, then it would be possible for multiple responses to be obtained for a single signal input to the board 20.

In this preferred embodiment, no column is anticipated to contain more than approximately three or four identical pieces 48 (pawns). If the rows and columns were interchanged, it is clear that the start position would have eight white pawns and eight black pawns being "interrogated" simultaneously. The eight column lines 22 extend across the eight rows and are terminated by 46, a resistance whose value approximates the characteristic impedance of the lines 22. Terminating a transmission line in its characteristic impedance in this case assures that the electromagnetic wave traveling towards the termination is almost totally absorbed and does not produce a significant reflected wave which would re-enter the board and possibly alter the planned operation.

In similar fashion, the lines 24 are connected to terminations 46 as shown. The selection switches 26 are a circuit which effectively produces a means for connecting a single input line coming into 26 to the column output lines 22 which become the transmission lines 50 beneath the playing surface of the board 20. In similar fashion, the row lines 24 become transmission lines 52 under the playing surface of the board 20 and interconnect the detectors 30 with terminations 46. Transmission lines 50 and 52 are actually pairs of wires of diameter "D" and spacing "S" to provide a characteristic impedance of "Z" ohms. In addition, the spaced wires render the precise location of the piece on the square fairly non-critical. There are many combinations of "D", "S", and "Z" which would allow the invention to be realized; one such set of parameters is D=0.06 inches, S=1.5 inches, and Z=500 ohms (approximately). Transmission lines 50 and 52 cross under the central portion of each playing square and are insulated from each other as illustrated in FIG. 5. The playing pieces 48, when placed on a square, are directly above transmission lines 50 and 52, as shown in FIG. 4.

Figure 3:
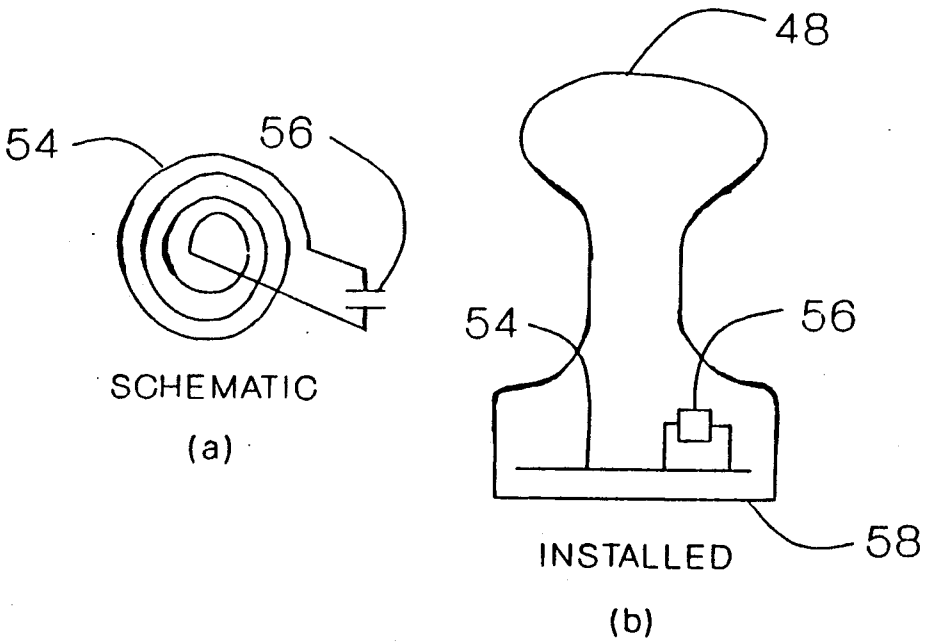
FIGS. 3*a* and 3*b* show a typical chess piece and the circuitry contained within according to the present invention.

A typical game piece 48 is shown in FIG. 3*b*. A tuned resonant circuit is installed in each piece 48, consisting of a coil 54 and a capacitor 56 also illustrated in FIG. 3*a*. There will be as many unique combinations of coils 54 and capacitors 56 as there are different types of playing pieces, with an anticipated maximum of 12, which corresponds to the twelve unique types of game pieces 48. One of the features of the invention is that the separation of frequencies can be such that the circuit of FIG. 3*a* can be realized such that no tuning is required after the circuit is fabricated. This is significant since the cost of tuning each piece after an entire chess set is fabricated can be the limiting factor on the overall cost of the set and therefore its potential market. The coils 54 can be reproduced very faithfully utilizing, for example, printed circuit techniques. The capacitors 56 can be purchased as high tolerance components which means their electrical value has been screened by the manufacturer and is guaranteed to be within a restricted range. Alternatively, the entire resonant circuit can be formed as a single unit utilizing printed circuit techniques. The invention takes into account the allowable range of electrical values of the coils 54 and the capacitors 56 and produces circuits shown in FIG. 3*a* which can be installed in their corresponding piece 48 without requiring subsequent electrical adjustment.

As shown in FIG. 3*b*, coil 54 is positioned parallel and close to the base 58 of piece 48 which places the coil 54 in close proximity to the transmission lines 50 and 52 just below the square that piece 48 occupies. In this manner, the resonant circuit in piece 48 causes a signal at the resonant frequency of piece 48 which is impressed onto transmission line 50 to be transferred to transmission line 52 and detected by 30. In fact, when that signal is impressed onto a particular transmission line 50, a piece tuned to that frequency on any of the eight rows which cross that column will cause a signal to appear at detector 30 corresponding to that particular row 52. Pieces 48 which are tuned to one of the other frequencies will not cause a signal to appear at a detector 30 even if it is on the column being energized. This, then, is the key to piece identification and location. Each one of the piece types is searched for sequentially, and its location noted by a response at a particular detector 30. Only a piece 48 which is tuned to the frequency of the impressed signal can respond. If similar pieces 48 were on a column 50 being energized by a signal at its corresponding frequency, the circuit in each piece 48 would cause a signal to appear on more than one row 52 and be detected by more than one detector 30. Since the total power traveling along column 50 must now divide between the various rows 52 due to the presence of more than one proper piece 48, it is obvious that the power level on each of these rows 52 will be less than the case where only one piece 48 could cause power to appear on any particular row 52. Also, the more similar pieces being detected simultaneously, the lower the power level on each row 52. This situation is solved by supplying sufficient signal strength to column 50 that the signal arriving at detector 30 is sufficient to saturate an amplifier (not shown) used in conjunction with detector 30.

Figure 4:
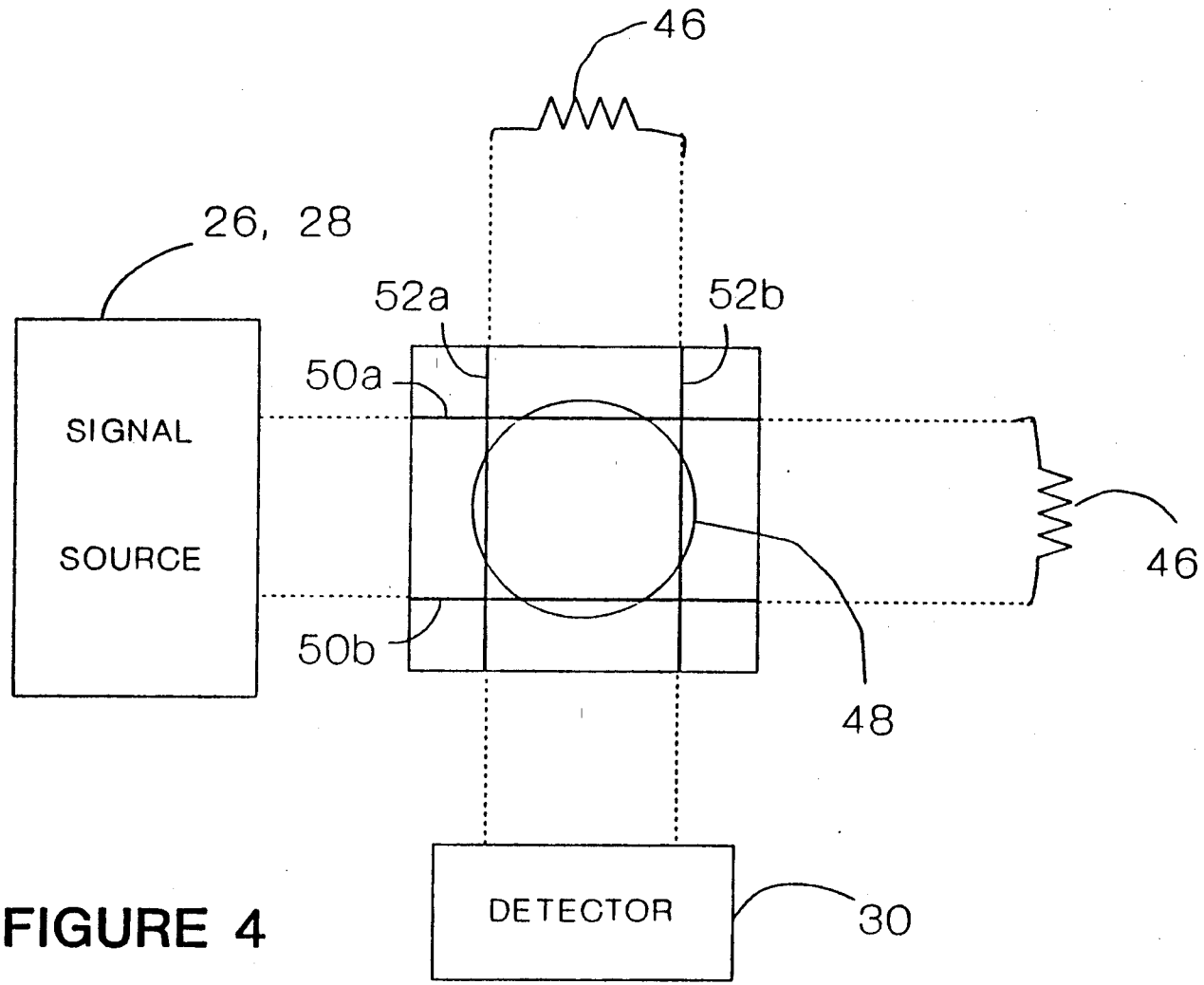
FIG. 4 shows an enlarged view of a typical chess board square and the transmission lines which are directly beneath the playing surface with an outline of a playing piece according to the present invention.
Figure 5:
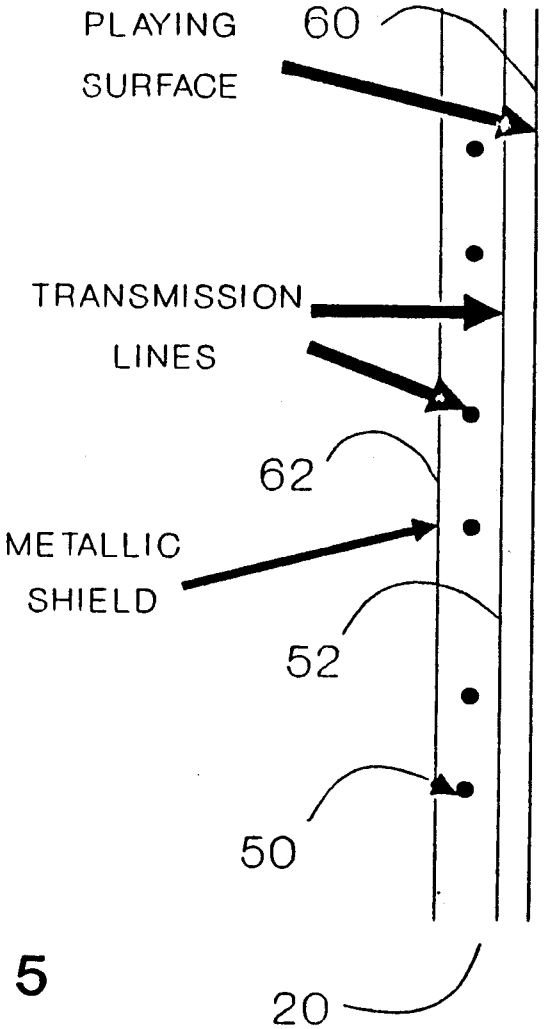
FIG. 5 shows a cross-sectional end view of a portion of the board according to the present invention.

FIG. 4 shows a close-up of a typical square of the board 20. Here, transmission lines 50 and 52 are shown to actually be two wire transmission lines of characteristic impedance Z. The value of Z typically is between 75 and 500 ohms. Terminations 46 can be resistors of value Z, which would properly terminate the transmission line and inhibit any energy incident on the termination from being reflected back towards the source. Any such reflection would have a negligible effect on the identification process, but would contribute to radiation from the assembly. As shown, transmission lines 50 and 52 are orthogonal to each other and therefore couple negligibly to one another without the presence of a tuned chess piece 48. However, when a piece 48 is positioned proximate to the intersection of transmission lines 50 and 52, i.e., not necessarily directly above the intersecting points, as shown, and the frequency of the signal on 50 matches the resonant frequency of the piece 48, an amplified electromagnetic field builds up in the vicinity of coil 54. It is this electromagnetic field which couples to transmission line 52 and causes a signal to travel on transmission line 52 to the detector 30. The type of signal employed for this purpose is known in the trade as a continuous wave, or CW signal. This is also significant, since the prior art employed what is known as a pulsed signal, which is generated by starting with a CW signal and turning it on or off very rapidly. It is the process of turning the signal on or off rapidly which gives rise to high levels of radiation from the board system. Since the present invention utilizes a CW signal which is not switched on or off, the level of radiation from a board system employing the present invention is very low or negligible. Use of a CW signal is the preferred embodiment as it results in the lowest level of radiation from the board. However, it should be noted that the invention could utilize signals that are turned on and off. The more rapidly the signals are turned on and off, the greater the radiation from the board.

A cross-section of the board 20 is shown in FIG. 5. Transmission lines 52 are shown in one layer just beneath the board playing surface 60, while transmission lines 50 are shown on a distinctly separate layer below 52. These transmission lines 50 and 52 can typically by printed on both sides of a single insulated plastic sheet such a Mylar (registered trademark of the Dupont Co.), a polyester film, which could be as thin as 0.001 to 0.003 inches. A thin plastic sheet would then cover the transmission lines 50 and complete the assembly. It should be noted that the position of transmission lines 50 and 52 could be interchanged without affecting the operation of the board, or the transmission lines 50, 52 could even occupy a common layer if care is taken to insulate the intersecting points.

Utilization of the present invention makes it possible to fabricate a very thin flexible board assembly, one that could be rolled up, as some popular regular boards are capable of. No "smart" board according to prior art has this capability. In addition, it is difficult to fabricate boards according to prior art which are much smaller than tournament size, which incorporate approximately 2¼ inch squares. The present invention can be used to produce very small boards since transmission lines 50 and 52 can be made very small, and the resonant circuits in the pieces 48 can be designed to fit the physical size of the piece 48. The smaller board according to the present invention will cost less in production than a large board due primarily to small size of the printed circuits and the pieces. However, the complexity of a board according to prior art increases as the board becomes smaller and therefore the prior art smaller board becomes more expensive. A metallic shield 62 is placed on the underside of the board to shield the electromagnetic fields surrounding the two wire transmission lines from external effects, such as the particular table surface the board may be placed upon, or from the other circuits which comprise the board system. This metallic shield alters the impedance of the two wire lines, and has the effect of lowering the characteristic impedance Typically, a two wire line of 500 ohms could be changed to a line of, say, 300 ohms in the presence of the shield.

Figure 6:
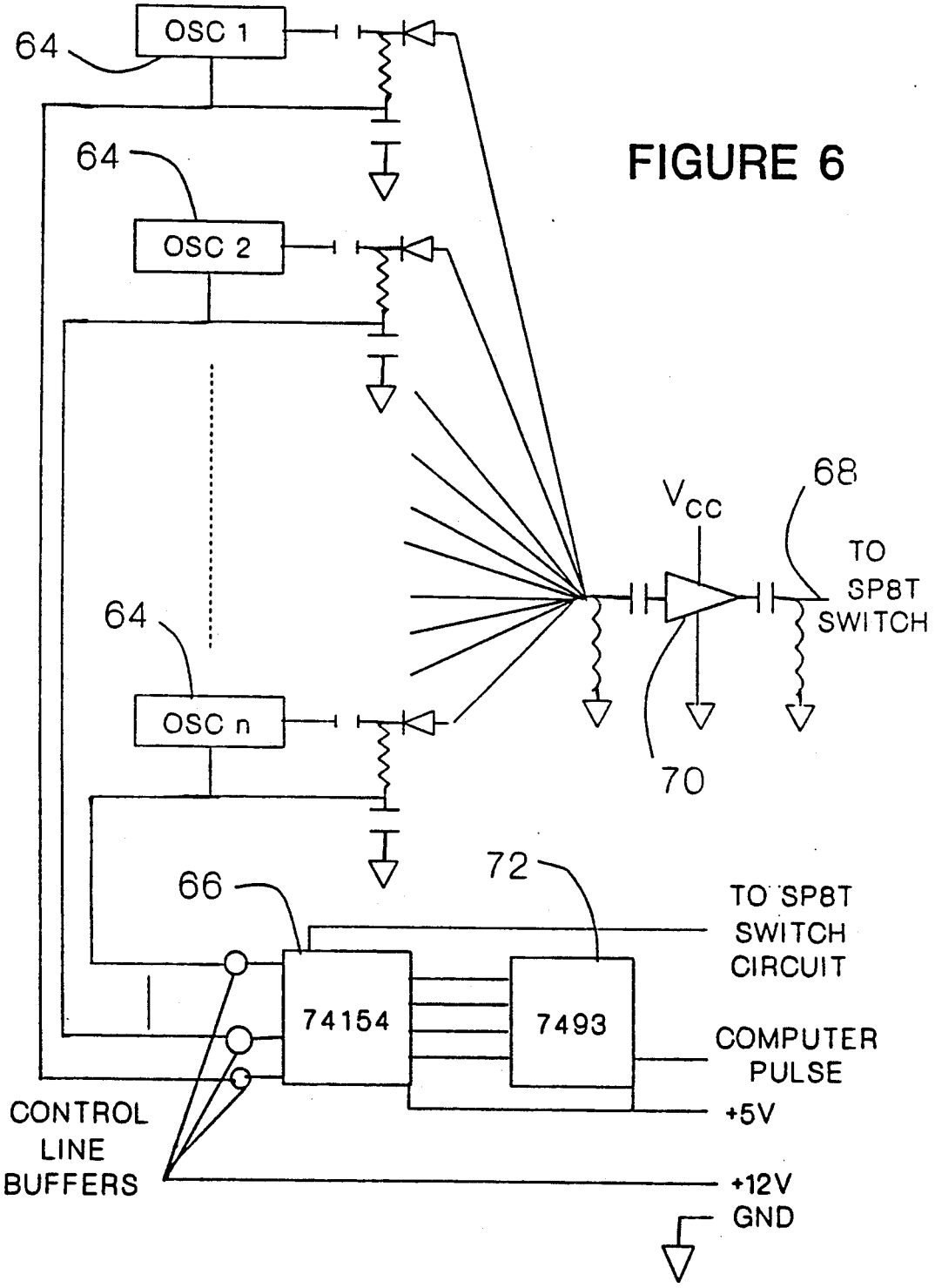
FIG. 6 shows an implementation of a frequency source selection circuit according to the present invention.

FIG. 6 shows a schematic of a frequency source selector 28 which could be employed in conjunction with the present invention. The "n" oscillators 64, are the source of the signals which are applied to the selection switches 26 in order to search for pieces 48. The oscillators 64 are controlled by commercially available integrated circuits (ICs) 66, 72. The ICs shown in the figure are manufactured by various suppliers and have become common building blocks in the industry, but other equivalent units are available. IC 66 converts a 4-bit computer address to 16 discrete line controls (on/off), while IC 72 has the capability to count the number of pulses applied to the circuit. A buffer amplifier 70 is suggested to isolate the oscillators 64 from the selection switches 26 fed by transmission line 68.

Figure 7:
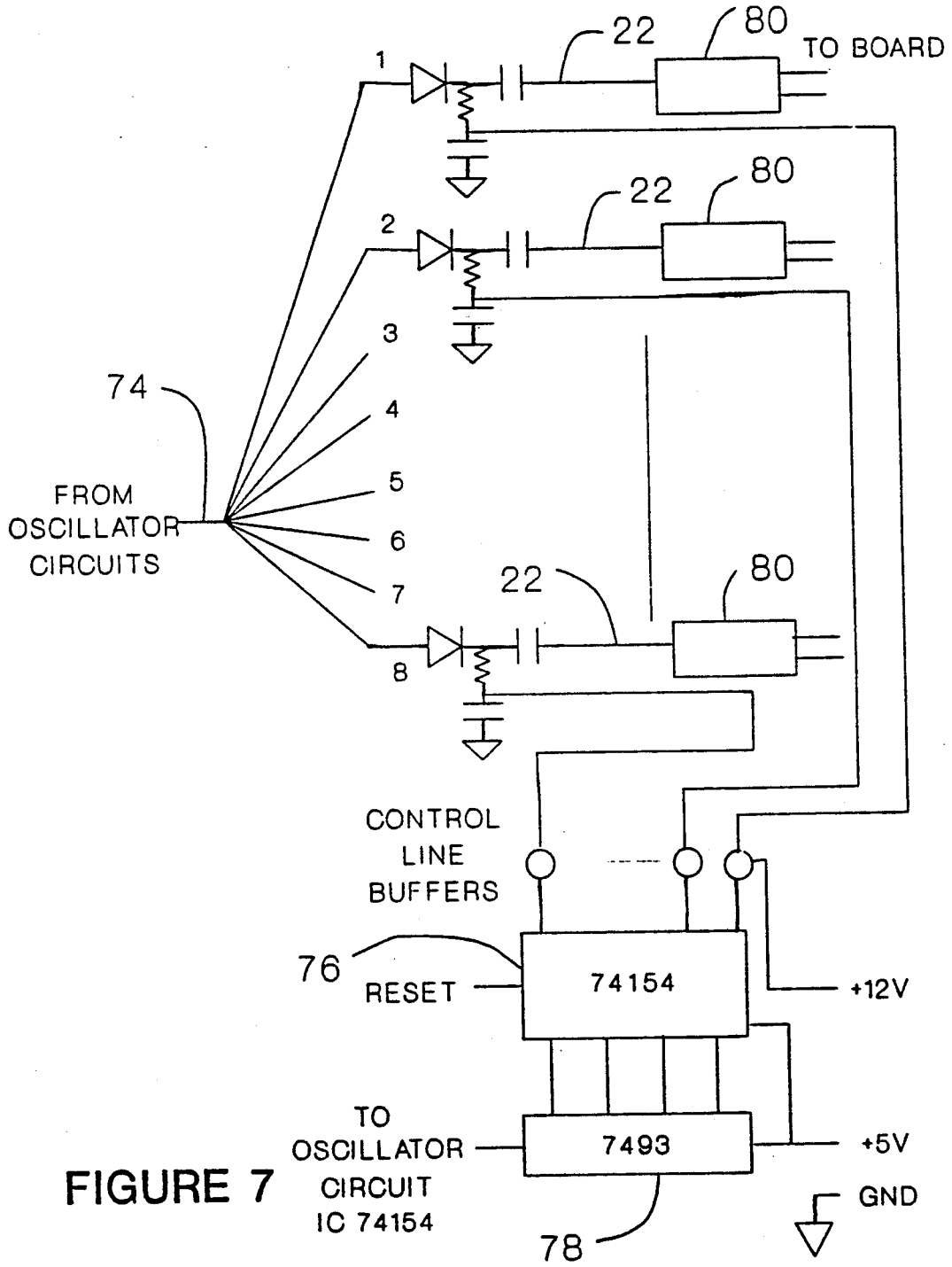
FIG. 7 shows an implementation of a switch selection circuit according to the present invention.

FIG. 7 shows a schematic of a switch selector 26 which could be employed in conjunction with the present invention. Transmission line 74 is a continuation of transmission line 68, and transmission lines 22 are connected to board 20 via baluns 80. The ICs 76, 78 are the same or similar to ICs 66, 72 respectively.

Figure 8:
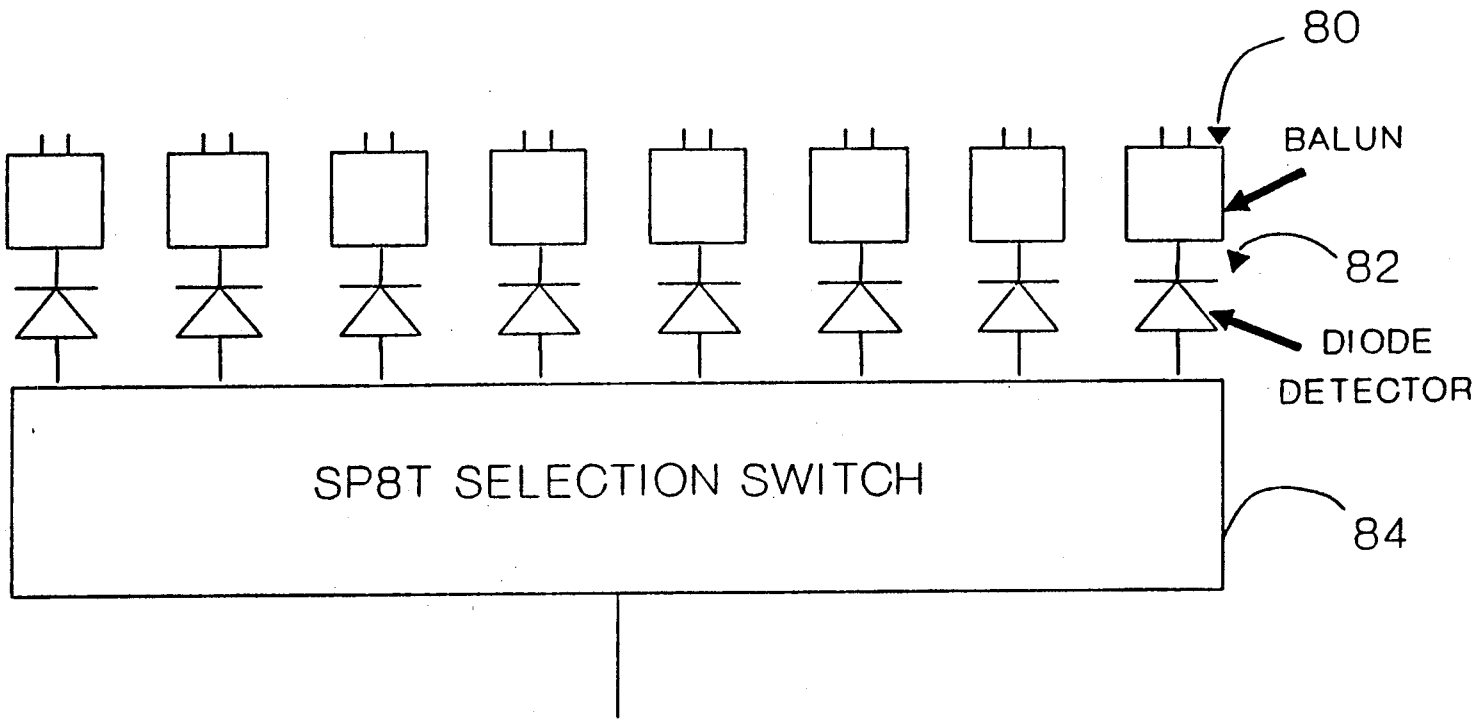
FIG. 8 shows an implementation of a detector selection circuit according to the present invention.

FIG. 8 shows how the rows are sampled in order to determine if a piece was located. Baluns 80 are connected to diode detectors 82 which are connected to a SP8T selection switch 84.

Figure 9:
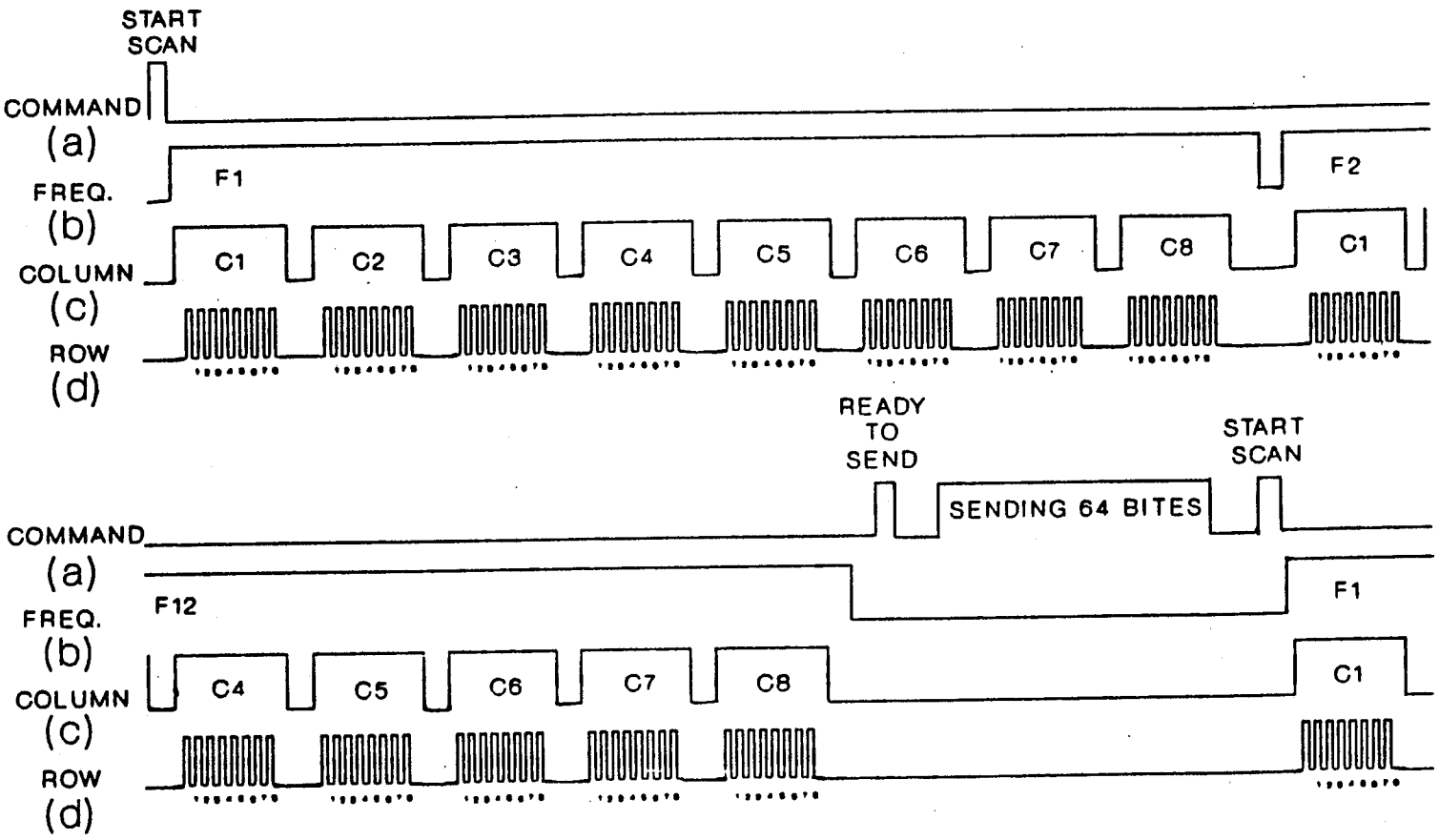
FIG. 9 shows a switching sequence for accomplishing piece location and recognition according to the present invention.

FIG. 9 shows the sequence of operation. The search for pieces starts with the "start scan" command (a). Frequency F1 is selected (b) and columns C1 through C8 are selected sequentially (c). While each column is connected to the frequency source, rows 1 through 8 are selected sequentially (d). After every column and row are selected at F1, the frequency is advanced to F2 and the process repeated until all columns and rows associated with F12 are selected. At this time, a "ready to send" command (a) is sent to the computer and a stream of data (64 bites) is sent to the computer over the serial interface. A "start scan" command causes the whole sequence to be repeated.

Figure 10:
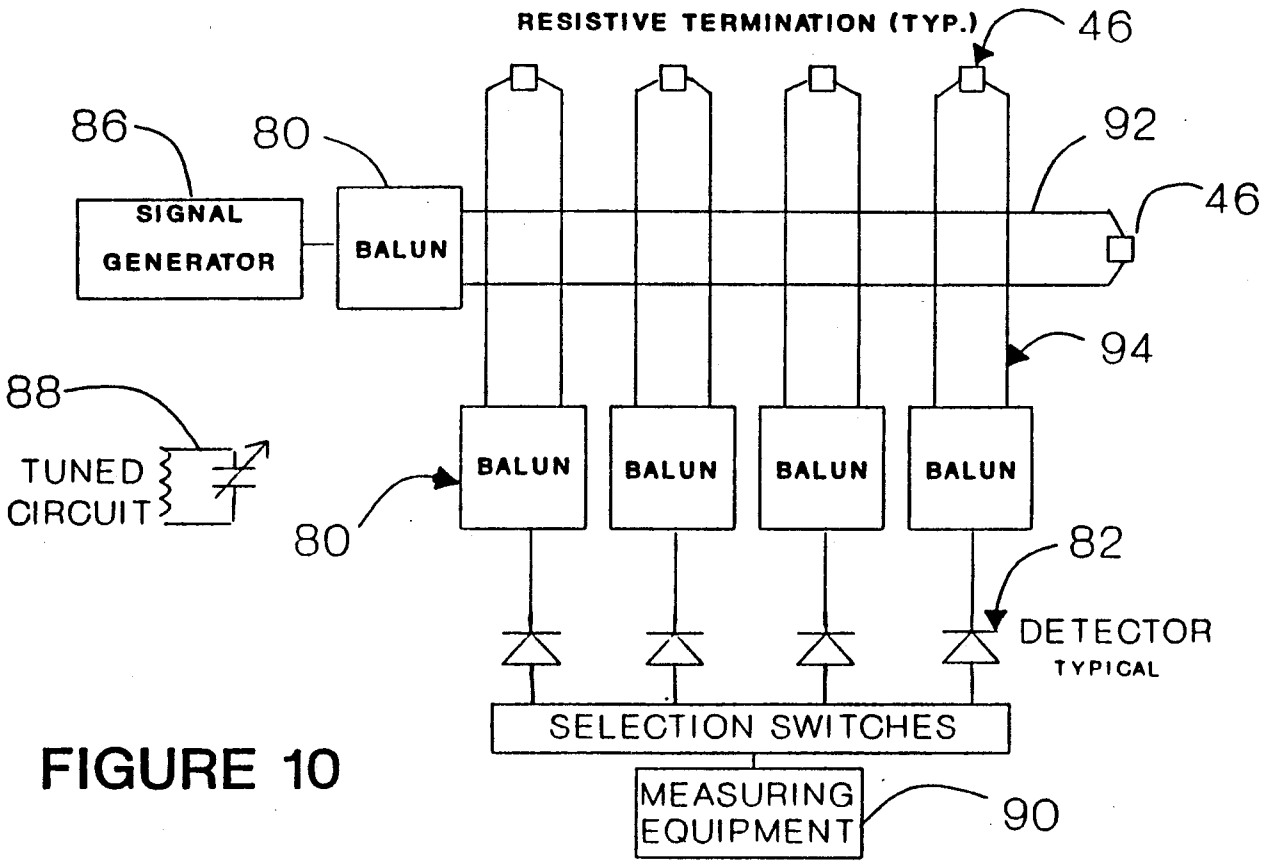
FIG. 10 shows a test setup utilized for a proof-of-concept experiment.

FIG. 10 demonstrates the ability of a chess piece 48 containing a tuned circuit 88 to cause power from a signal generator 86 providing a typically 25 MHz (approximately) CW signal and balun 80 through transmission line 92 to be transferred to transmission line 94 and be detected by balun 80 and detector 82 and indicated on measuring equipment 90. The coupling between the transmission lines 92 and 94 are so low without the presence of resonant circuit 88 that the resulting signal strength at the measuring equipment 90 is estimated to be more than 60 db below the signal level from the signal generator. When tuned circuit 88, in the form of a one inch diameter 6-turn coil tuned with a variable capacitor estimated to be in the range of 20–50 pf, was then placed over the intersection of the two transmission lines 92 and 94, and the frequency of the signal from the signal generator 86, preferably a Hewlett-Packard model 606, was adjusted until it matched the resonant frequency of the "piece" 48, there was a sharp peak in the response as indicated on the measuring equipment 82, 90. Detector 82 is a crystal detector which is a common microwave component known to those who practice the art. The measuring equipment is preferably a Hewlett-Packard model 415 Indicator. Under these circumstances, the coupling between the transmission lines 92 and 94 was approximately −30 db, an increase of at least 30 db over the uncoupled condition. The experiment involved four parallel transmission lines 94 which crossed a single transmission line 92 to uniquely detect four different pieces 48 positioned on the four intersections between lines 92 and 94. Each detector 82 responded as the signal generator 86 was tuned through the resonant frequency of the tuned circuit 88 inside each piece 48. The frequency was approximately 25 MHz and the pieces were tuned approximately one MHz apart. There was minimal interaction between pieces 48. The experiment established that the invention could positively detect the presence of a chess piece 48 containing a resonant circuit 88, and confirmed that the invention could differentiate between different chess pieces 48 on a common column on the board 20 at the same time.

Figure 11:
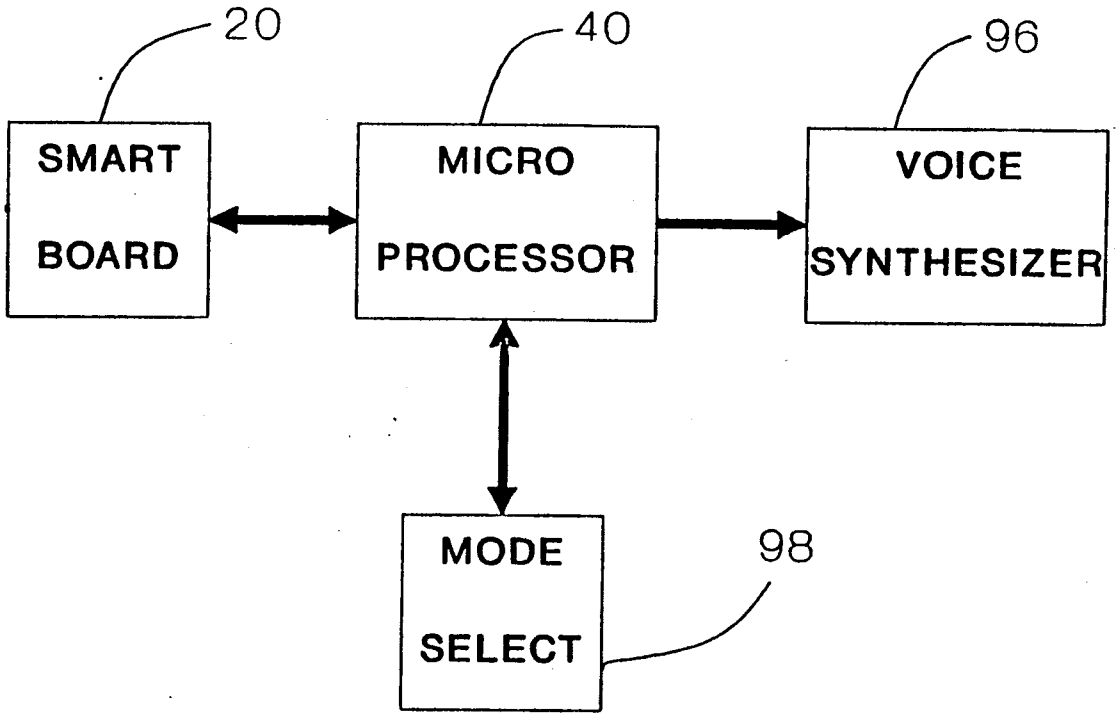
FIG. 11 shows a block diagram of a chess computer utilizing the present invention.

A very promising application for the invention is to utilize it in conjunction with a microprocessor 33 and a voice synthesizer 96 to produce a chess computer which eliminates all the present man-machine interfaces that make playing on a conventional chess computer awkward. A block diagram of such a chess computer is shown in FIG. 11. The mode select 98 function shown in the figure is for "degree of difficulty" as well as the "nomenclature" and "language" utilized by the synthesizer, as will be explained. For the first time, a chess computer will be available which will allow a player to make a move in a normal fashion by moving a normal looking chess piece on a normal looking chess board and have a microprocessor know the position of the piece. The chess computer then determines a countermove and utilizes the voice synthesizer to "tell" the player where to move one of the computer's pieces. This communication can be via a speaker or with an ear plug which would make such a chess game a truly personal experience, without any knowledge of computers or symbology required of the player. If the player moves the wrong piece for the computer, or moves the correct piece to the wrong square, the computer will know and can tell the player to correct the error. When the player makes the proper move per the computer's verbal instruction, the computer can tell the player that it is now his move. A built-in chess clock run by the computer will take these player response times into account and not penalize the player while making the computer's move. Another important feature of this chess computer is that the entire game can be recorded, and replayed at the player's discretion. The chess computer contains a means to input various choices at the players option. Examples of such choices could be: level of expertise of the chess computer (a feature contained in virtually every chess computer); the nomenclature to be utilized in describing the computer's move (e.g., Q to KB2 (descriptive), or QF2 (algebraic); and language (it is possible for the computer to "speak" to the player in his native tongue).

The present invention can be utilized to advantage for other board games besides chess. The following list is not all inclusive, but is presented to illustrate the type of board games that could make use of the invention. Any similar game not specifically listed herein should be considered to be listed by similarity.

1. "Monopoly": A "Monopoly" type board that could recognize each piece, know what properties were owned by which player, know what hotels and houses were on each property, etc. could be played by persons who would appreciate the board determining all financial transactions, etc. and guiding the play of the game.

2. "Scrabble": A "Scrabble" board that recognized the value of each letter, contained a spellcheck provision for settling challenges, determined the value of each word, and kept score could be played by persons who find it difficult to keep score or even to spell.

3. Backgammon; 4. Checkers; 5. Baseball; 6. Risk.

It will be recognized by those skilled in the art that changes may be made to the above-described embodiment of the invention without departing from the broad inventive concepts thereof. It is understood, therefore, that this invention is not limited to the particular embodiment disclosed, but is intended to cover all modifications which are within the scope and spirit of the invention as defined by the appended claims.

I claim:

1. An electronic game apparatus comprising:

a playing board having a playing surface and playing areas;

a first set of generally parallel transmission lines located beneath the playing surface of the playing board and arranged in a first direction;

a second set of generally parallel transmission lines located beneath the playing surface of the playing board, said second set of generally parallel transmission lines being arranged in a second direction different from the first direction of said first set of generally parallel transmission lines, said first and second sets of transmission lines forming intersecting points which are electrically isolated from one another, each said intersecting point being positioned proximate a playing area of said playing surface;

a source of electromagnetic energy having a plurality of predetermined different frequencies within a predetermined frequency range;

a plurality of game pieces each game piece containing a resonant circuit having a predetermined resonant frequency correspond a frequency within said predetermined frequency range;

selector means for sequentially supplying electromagnetic energy signals at selected frequencies within said predetermined frequency range to said first set of transmission lines;

detection means connected with said second set of transmission lines for detecting electromagnetic energy at a frequency within said predetermined frequency range on one of said transmission lines of said second set, whereby the presence of a game piece upon a playing area results in the generation of electromagnetic energy within a transmission line of said second set upon receipt by the resonant circuit within said game piece of electromagnetic energy from one of said transmission lines of said first set at a frequency corresponding to the resonant frequency of the resonant circuit within said game piece, said detection means detecting said electromagnetic energy within said transmission line of said second set to identify the playing area in which said game piece is located.

2. The electronic game apparatus according to claim 1, wherein each said resonant circuit of said game pieces comprises an inductance in parallel with a capacitance.

3. The electronic game apparatus according to claim 2, wherein similar game pieces each have a resonant circuit with similar resonant frequencies.

4. The electronic game apparatus according to claim 2, wherein said inductance comprises a single induction coil which has a relatively low ratio of output voltage to input voltage at its resonant frequency.

5. The electronic game apparatus according to claim 1, wherein said electromagnetic energy source comprises a means for generating a plurality of oscillating electromagnetic energy at selected frequencies within said predetermined frequency range.

6. The electronic game apparatus according to claim 5, wherein said selector means comprises a plurality of selection switches which determine the order in which the frequency signals are transmitted to said first set of transmission lines.

7. The electronic game apparatus according to claim 6 further comprising processing means for recognizing the presence of a game piece whose resonant circuit matches the selected frequency signal supplied by said selector means, and identifying the playing area on which said game piece is located.

8. The electronic game apparatus according to claim 7, wherein said processing means identifies the location of the identified game piece by identifying the transmission line of the first set which, when supplied with a frequency signal at a selected frequency corresponding to the resonant frequency of the identified game piece, identifying the transmission line of the second set upon which electromagnetic energy from the resonant circuit of the identified game piece was detected and identifying the game area proximate the intersecting point of the two identified transmission lines.

9. The electronic game apparatus according to claim 8, wherein said detection means detects a negligible signal when said frequency signal is transmitted to one of said playing areas which is not occupied by one of said game pieces.

10. The electronic game apparatus according to claim 8, wherein said detection means detects a negligible signal when said frequency signal is transmitted to one of said playing areas which is occupied by a game piece containing a resonant circuit not tuned to the said transmitted frequency signal.

11. The electronic game apparatus according to claim 1, wherein each of the transmission lines of said first set and second set of transmission lines comprises a two-wire transmission line.

12. The electronic game apparatus according to claim 11, wherein said playing board further comprises a single insulated sheet and wherein said first and second sets of transmission lines are located on opposite sides of said single sheet.

13. The electronic game apparatus according to claim 11, wherein said playing board further comprises a single insulated sheet and wherein said first and second sets of transmission lines are located on the same side of said sheet, such that said first and second sets of transmission lines are electrically isolated from one another at their intersecting points.

14. The electronic game apparatus according to claim 11, wherein said playing board further comprises a metallic shield located beneath, and isolated from said first and second sets of transmission lines, said first and second sets of transmission lines being located beneath and in close proximity to the playing surface, said metallic shield shielding the resonant circuits in the game pieces on the playing surface from the detuning effects of nearby signals and/or metallic objects, said metallic shield also shielding circuits which may be employed to control the board and which may be located beneath the playing surface and beneath the transmission lines.

15. The electronic game apparatus according to claim 11, wherein said first and second sets of transmission lines are terminated in their characteristic impedance, such that there are virtually no standing waves present on said transmission lines.

16. The electronic game apparatus according to claim 1, wherein said electromagnetic energy is a continuous wave signal.

17. An electronic game apparatus according to claim 1, wherein said second set of transmission lines are orthogonal to said first set of transmission lines.

18. An electronic game apparatus comprising:

a playing board having a playing surface and playing areas;

a first set of generally parallel transmission lines located beneath the playing surface of the playing board;

a second set of generally parallel transmission lines located beneath the playing surface of the playing board, said second set of generally parallel transmission lines being orthogonal to said first set of generally parallel transmission lines, said first and second sets of transmission lines forming intersecting points which are electrically isolated from one another, each said intersecting point being positioned proximate a playing area of said playing surface;

a source of electromagnetic energy having a plurality of predetermined different frequencies within a predetermined frequency range;

a plurality of game pieces each game piece containing a resonant circuit having a predetermined resonant frequency correspond a frequency within said predetermined frequency range;

selector means for sequentially supplying electromagnetic energy signals at selected frequencies within said predetermined frequency range to said first set of transmission lines, said selector means including selector switches which determine the order in which the frequency signals are transmitted to the first set of transmission lines;

detection means connected with said second set of transmission lines for detecting the presence of electromagnetic energy from the resonant circuit of a game piece at a frequency within said predetermined frequency range on one of said transmission lines of said second set; and processing means for receiving information identifying the frequency of each of the frequency signals supplied by the selector means, the transmission line of the first set to which the frequency signals are supplied and the transmission line of the second set upon which electromagnetic energy from a game piece resonant circuit is detected and for identifying the playing area upon which each game piece is located, whereby the presence of a game piece upon a playing area results in the generation of electromagnetic energy within a transmission line of said second set upon receipt by the resonant circuit within said game piece of electromagnetic energy from a transmission line of said first set at a frequency corresponding to the resonant frequency of the resonant circuit within said game piece, said detection means detecting said electromagnetic energy within said transmission line of said second set and said processing means identifying the particular game piece by the frequency of the resonant circuit and identifying the playing area upon which the identified game piece is located by identifying the playing area proximate the intersecting point of the transmission line of the first set which, when supplied with a frequency signal at a selected frequency caused the resonant circuit of the identified game piece to resonate and identifying the transmission line of the second set upon which electromagnetic energy from the resonant circuit of the identified game piece was detected.

19. An electronic game apparatus comprising:

a playing board having a playing surface and playing areas;

a first set of generally parallel transmission lines located beneath the playing surface of the playing board and extending in a first direction; and a second set of generally parallel transmission lines located beneath the playing surface of the playing board, said second set of generally parallel transmission lines extending in a second direction different from the first direction, said first and second sets of transmission lines forming intersecting points which are electrically isolated from one another, each said intersecting point being positioned proximate a playing area of said playing surface.

20. An electronic game apparatus according to claim 19 wherein said second set of transmission lines are orthogonal to said first set of transmission lines.

21. An electronic game apparatus comprising:

a playing board having a playing surface and playing areas;

a first set of generally parallel transmission lines located beneath the playing surface of the playing board;

a second set of generally parallel transmission lines located beneath the playing surface of the playing board, said second set of generally parallel transmission lines being orthogonal to said first set of generally parallel transmission lines, said first and second sets of transmission lines forming intersecting points which are electronically isolated from each other, each said intersecting point being positioned proximate a playing area of said playing surface;

a source of electromagnetic energy having a predetermined frequency;

a plurality of game pieces, each game piece containing a resonant circuit having a resonant frequency;

selector means for sequentially supplying electromagnetic energy signals at said predetermined frequency to said first set of transmission lines, said selector means including selector switches which determine the order in which the signals are transmitted to the first set of transmission lines;

detection means connected with said second set of transmission lines for detecting the presence of electromagnetic energy from the resonant circuit of a game piece on one of said transmission lines of said second set; and processing means for receiving information identifying the transmission line of the first set to which said electromagnetic energy signals are supplied and the transmission line of the second set upon which electromagnetic energy from a game piece resonant circuit is detected and for identifying the playing area upon which a game piece is located, whereby the presence of a game piece upon a playing area results in the generation of electromagnetic energy within a transmission line of said second set upon receipt of the resonant circuit within said game piece of electromagnetic energy from a transmission line of said first set at the resonant frequency, said detection means detecting said electromagnetic energy within the transmission line of said second set and said processing means identifying the playing area upon which the game piece is located by identifying the playing area proximate the intersecting point of the transmission line of the first set which, when supplied with a signal at the predetermined frequency, causes the resonant circuit of the game piece to resonate and identify the transmission line of the second set upon which electromagnetic energy from the resonant circuit of the game piece is detected.

* * * * *